United States Patent [19]

Powell

[11] 4,076,189

[45] Feb. 28, 1978

[54] KITES

[75] Inventor: Peter Trevor Powell, Cheltenham, England

[73] Assignee: Peter Powell International Limited, Gloucester, England

[21] Appl. No.: 705,891

[22] Filed: Jul. 16, 1976

[30] Foreign Application Priority Data

Jul. 16, 1975 United Kingdom ..... 29844/75
Mar. 6, 1976 United Kingdom ..... 9076/76

[51] Int. Cl.[2] ..... B64C 31/06
[52] U.S. Cl. ..... 244/153 R
[58] Field of Search ..... 244/153–155, 244/1 TD; 273/105.3; D34/15 AF

[56] References Cited

U.S. PATENT DOCUMENTS

| | | | |
|---|---|---|---|
| 1,849,133 | 3/1932 | Baker | 244/154 |
| 2,216,776 | 10/1940 | Hoffman | 273/105.3 |
| 2,960,298 | 11/1960 | Jones | 244/153 R |
| 3,062,488 | 11/1962 | Sulger | 244/155 R |
| 3,091,420 | 5/1963 | Deguin | 244/155 R |
| 3,100,895 | 8/1963 | Resnick | 244/153 R |
| 3,954,235 | 5/1976 | Powell | 244/153 R |

FOREIGN PATENT DOCUMENTS

| | | | |
|---|---|---|---|
| 1,267,933 | 3/1972 | United Kingdom | 244/153 R |

*Primary Examiner*—Galen L. Barefoot
*Attorney, Agent, or Firm*—Young & Thompson

[57] ABSTRACT

A kite is provided with a streamer in the form of an elongated, inflatable, flexible tube of, for example, polyethylene. The streamer is attached to the main spar of the kite and has an open mouth positioned beneath the kite sheeting so that, in flight, the streamer is filled with air.

4 Claims, 3 Drawing Figures

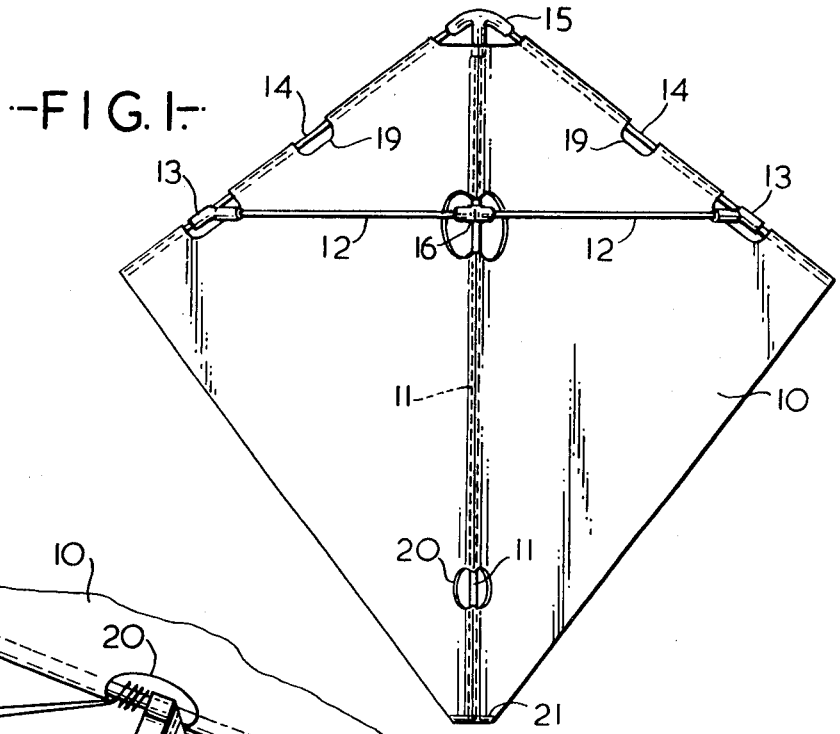
-FIG. 1-
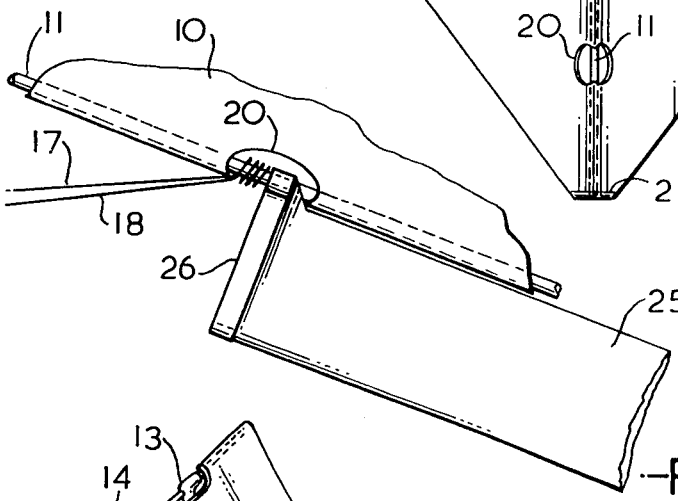
-FIG. 2-
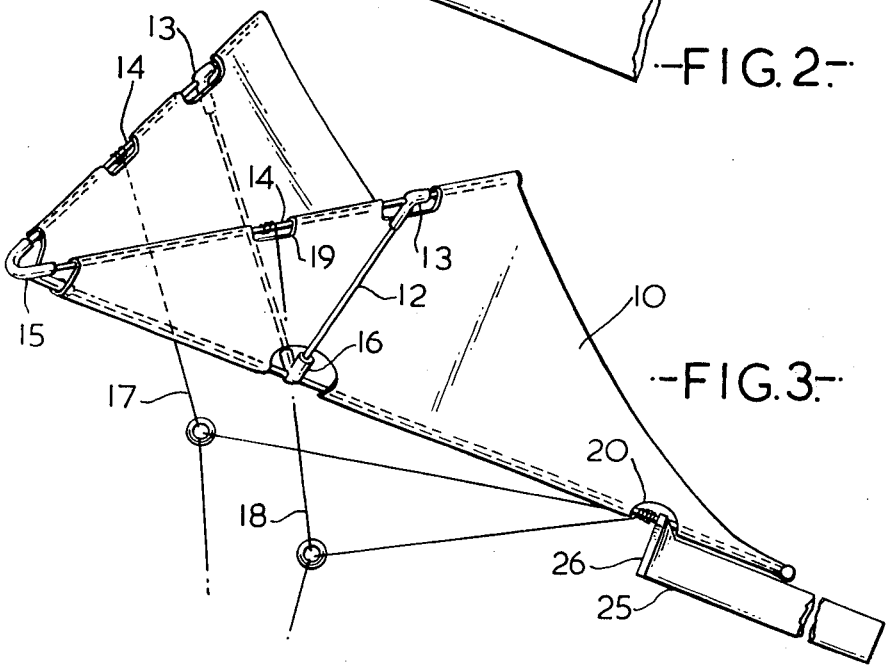
-FIG. 3-

KITES

This invention relates to kites and is concerned with the provision of an improved device for use with a kite.

According to the invention there is provided the combination of a kite and a streamer for attachment to the kite in the form of an elongated, inflatable, flexible tube.

The tube from which the streamer is formed preferably has a length at least two orders of magnitude greater than the diameter thereof, for example, the tube may have a length of sixty or seventy five feet and a circumference of 6 inches, the tube being of constant cross-section throughout its length with an open mouth at one end thereof and with the other end closed or intended to be closed by knotting.

Reinforcement means in the form of a tape may be provided at said one end of the tube, said reinforcement means serving to strengthen said one end and to ensure that said one end will tend to adopt a circular condition and thereby afford an open mouth. The kite preferably comprises sheeting spread by a longitudinal spar and a flexible lateral spar and attachment of the streamer to the kite may be effected by the provision of an opening in said reinforcement tape through which the longitudinal spar of the kite is passed.

The tail end of the longitudinal spar is preferably detachably connected to the sheeting by fitment of said tail end in a bore in a transverse rod to which the material of the sheeting is bonded. Said one end portion of the streamer is preferably passed through an opening in the sheeting, the tail end of the longitudinal spar is removed from the bore in the end of the transverse rod, the end of the longitudinal spar is refitted in the bore in the bore in the transverse rod.

The tube may be formed of polyethylene, typically 150 gauge, with the height of the tube, for example, four ounces. In flight, however, because the open mouth of the streamer is positioned so that air will enter said mouth, the streamer will fill with air and will follow the flight of the kite. As the kite is caused to execute a series of manoeuvres, the shape of the streamer will be changed in dependence on the mode of movement of the kite so that an experienced kite-flier can cause the streamer to adopt a variety of configurations and can achieve a form of sky-writing. The visual effect of the streamer is particularly enhanced if a plurality of kites, each having streamers, are interconnected so as to fly in unison.

The invention will now be described by way of example with reference to the accompanying drawings in which:

FIG. 1 is a face view of a kite,

FIG. 2 is a detail view of an enlarged scale illustrating attachment of a streamer to the kite, and FIG. 3 is a perspective view illustrating the kite and streamer in flight.

The kite comprises polyethylene sheeting 10 which is spread by means of a longitudinal or backbone spar 11 formed of hollow plastics tubing of ¼ inch outside diameter and a flexing lateral spar 12 which extends between brackets 13 located at intermediate points along tubular bracing members 14 which extend along the leading edges of the sheeting 10 and are contained within seams formed by folding over the leading edge portions of the sheeting and effecting a welding operation.

A resiliently deformable, generally arrowheadshaped nose element 15 formed of highly plasticised polyvinylchloride is disposed at the head end of the longitudinal spar 11 and is connected thereto by fitment of the spar 11 in a bore afforded by the stem of the arrowhead. The arms of the arrowhead are inclined as shown and have bores which receive the forward ends of the bracing members 14 which are also formed of hollow plastics tubing of one-fourth inch outside diameter. The brackets 13 between which the lateral spar is fitted are plastics tubes of highly plasticised polyvinylchloride which are apertured intermediate their ends and bent to form two relatively inclined portions one of which receives the associated bracing member 14 and the other of which receives an end of the lateral spar 12.

The lateral spar 12 is formed as two separate parts of equal length each comprising a plastics rod of 3/16 inches diameter and the outer ends of the rods are secured in the bores afforded by said other portions of the brackets 13. A plastics moulding 16, again of polyvinylchloride, is provided for interconnecting the longitudinal spar 11 and the lateral spar 12; the moulding is of generally V configuration with the junction between the arms of the V provided with a bore in which the longitudinal spar 11 is received. The arms of the V are inclined to one another at an angle of about 160° to 170° and provide bores in which the inner ends of the rods forming the lateral spar 12 are received. The lateral spar 12 thus serves as two flexible interconnected wing struts which spread the sheeting 10 in two back-inclined wing portions on either side of the longitudinal spar as shown in FIG. 3. In flight, the wing portions yield to increasing air pressure and hinge backwardly against the restoring force afforded by the resistance of the plastics rods forming the lateral spar 12. This yielding of the wing portions of the kite makes for stable flying; it gives directional control to the operator and ensures that neither the operator nor the structural members of the kite are overstressed. As the wind pressure increases, the degree of flexing of each of the plastics rods increases and a substantially constant line tension is maintained.

Two separate tethering loops 17 and 18 are provided, one for each wing portion, as shown in FIG. 3. Each loop 17, 18 has a ring for a kite string and extends from a point on the corresponding bracing member 14 above the bracket 13 on a position on the longitudinal spar near the bottom end thereof. Cut-outs 19 and 20 are formed in the sheeting 10 to facilitate attachment of the ends of the loops. The tail end portion of the sheeting is wrapped around a transverse rod 21 indicated in outline in FIG. 1 and is reinforced by adhesive tape. The transverse rod is formed with a bore and the end portion of the longitudinal spar 11 is removably fitted in said bore.

The parts of the kite are normally provided and retained in an assembled state but with the inner ends of the rods forming the lateral spar 12 removed from the respective bores in the moulding 16 and, for stowage and transport, the bracing members 14 are folded against the longitudinal spar 11 by flexure of the nose element 15 and the folds of the sheeting 10 are wrapped around the longitudinal spar 11, the two parts of the lateral spar 12 and the bracing members 14 for acommodation in a polyethylene stowage tube (not shown). In order to complete assembly of the kite for flying after removal from the stowage tube, the inner ends of the two plastics rods forming the lateral spar 12 are each fitted within the associated bore of the V-shaped moulding 16 on the longitudinal spar 11. As can be seen from the drawings, the longitudinal spar 11 lies to the rear of the sheeting 10 and the lateral spar 12 lies to the front of the sheeting 10.

A streamer 25 formed of tubular polyethylene sheeting is attached to the longitudinal spar 11 and at one end the mouth of the polyethylene tube is reinforced by a strip of adhesive tape 26 which is formed with an aperture slightly greater in diameter than the longitudinal spar 11. The end of the streamer 25 is passed through the opening 20 in the sheeting 10, the tail end of the spar 11 is removed from the bore in the transverse rod and then the end of the spar 11 is inserted in the open mouth of the tube and passed through the aperture in the adhesive tape 26 so that, in flight, as shown in FIG. 2, the open mouth of the streamer 25 is positioned in the airflow beneath the kite inflation of the streamer will be effected. The streamer 25 is of constant cross-section throughout its length and the other end thereof is closed by means of a knot.

An important advantage of the invention is that the open mouth of the streamer 25 is positioned close to the sheeting 10 at a position such that, as air flows over the sheeting 10, the airflow will be directed into the open mouth and the streamer 25 will be inflated by an extent dependent to some extent on the wind speed. Thus, before the kite ascends into the air, i.e. at launching, the retarding effect of the streamer 25 will depend solely on the weight thereof whereas, when the kite is in the air, the drag will be dependent on the wind speed.

When using a streamer 75 feet in length, six inches in circumference and weighing between 3 and 4 ounces, it has been found that a minimum speed of six miles per hour is necessary to effect launching of the kite whereas, without the streamer, the kite could be launched with a wind speed of five miles per hour.

Inflation of the streamer during flight means that the streamer does not tend to flap or flutter and follows a smooth possibly undulating path having a pleasing visual effect. The resistance to flight of the kite is kept to a minimum because of the smooth contour of the streamer and the kite's performance is not adversely effected.

The plastics tubing of the longitudinal spar 11 and the bracing members 14 is desirably of polyester resin reinforced with glass fibres but other plastics materials may be used. The rods forming the lateral spar 12 may likewise be formed of glass-fibre-reinforced polyester resin. The frame and sheeting of the kite are thus of electrically insulating materials and problems which have arisen with metal-framed kites and thus avoided.

What I claim is:

1. The combination of a kite and a streamer for attachment to the kite in the form of an elongated, inflatable, flexible tube, the tube from which the streamer is formed being of constant cross section throughout its length, the tube having an open mouth at one end thereof and the other end of the tube being closed, reinforcement means in the form of a tape that is provided at said one end of the tube, the reinforcement means serving to strengthen said one end of the tube and to insure that it will adopt a generally circular configuration and thereby afford an open mouth, the kite comprising sheeting spread by a longitudinal spar and a flexible lateral spar, there being an opening in said reinforcement tape for attachment of the streamer to the kite by passage of the longitudinal spar of the kite through said opening.

2. The combination according to claim 1, wherein the tail end of the longitudinal spar is detachably connected to the sheeting by fitment of said tail end in a bore in a transverse rod bonded to the sheeting.

3. The combination of a kite and a streamer for attachment to the kite in the form of an elongated, inflatable, flexible tube which is of constant cross-section throughout its length, the tube having an open mouth at one end thereof with the other end of the tube being closed, and the tube having a length at least two orders of magnitude greater than the diameter thereof, the kite comprising a longitudinal spar connected by flexible jointing means to bracing members extending along the leading edges of the kite, and reinforcement means in the form of a tape being provided around the open mouth of the tube with an opening in the reinforcement tape for attachment of the tubular streamer to the kite by passage of the longitudinal spar through said opening.

4. The combination according to claim 3, wherein the streamer is of the order of seventy five feet in length and six inches in circumference.

* * * * *